US007458882B2

(12) United States Patent
Izmailov

(10) Patent No.: US 7,458,882 B2
(45) Date of Patent: Dec. 2, 2008

(54) ADJUSTABLE HANDHELD TOOL

(76) Inventor: Assan Izmailov, 5296 St. Helenn Hwy., Napa, CA (US) 94558

( * ) Notice: Subject to any disclaimer, the term of this patent is extended or adjusted under 35 U.S.C. 154(b) by 46 days.

(21) Appl. No.: 11/717,438

(22) Filed: Mar. 12, 2007

(65) Prior Publication Data

US 2007/0212991 A1 Sep. 13, 2007

Related U.S. Application Data

(60) Provisional application No. 60/781,045, filed on Mar. 10, 2006.

(51) Int. Cl.
*B24B 23/00* (2006.01)

(52) U.S. Cl. ..... 451/344; 451/359

(58) Field of Classification Search ..... 451/344, 451/354, 355, 356, 357, 358, 359
See application file for complete search history.

(56) References Cited

U.S. PATENT DOCUMENTS 5,339,572 A * 8/1994 Eicher ..... 451/358
6,155,916 A * 12/2000 Rudolf et al. ..... 451/344
6,602,122 B1 * 8/2003 Rudolf et al. ..... 451/344
7,175,513 B2 * 2/2007 Folin ..... 451/359
2003/0190877 A1 * 10/2003 Gallagher et al. ..... 451/344
2006/0025060 A1 * 2/2006 Funk ..... 451/358
2006/0258274 A1 * 11/2006 Oki et al. ..... 451/358
2008/0014844 A1 * 1/2008 Pontieri ..... 451/359
2008/0102739 A1 * 5/2008 Sun et al. ..... 451/358

* cited by examiner

*Primary Examiner*—Eileen P. Morgan

(57) ABSTRACT

An adjustable handle is attached to a power tool having a tool head and a motor housing. When the handle is loosened, the tool head can rotate relative to the motor housing and the handle can be rotated relative to the power tool. When the handle is tightened, the tool head does not rotate relative to the motor housing and the handle does not rotate relative to the power tool. The adjustable handle allows the user to easily reconfigure the power tool for use in confined spaces or special applications.

20 Claims, 11 Drawing Sheets

ADJUSTABLE HANDHELD TOOL

CROSS REFERENCE TO RELATED PATENT APPLICATIONS

This applications claims priority to U.S. Provisional Application No. 60/781,045 "Adjustable Handheld Tool" which was filed on Mar. 10, 2006 and is hereby incorporated by reference.

BACKGROUND

Handheld power tools may require holding the tools in a variety of positions in order to cut, grind, drill, fasten, or perform other operations on a workpiece. Power tools often have a body and a grip that has a button that allows the user to turn the power tool on and off. At the opposite end of the grip is the tool head, which has a tool disk that is angled relative to the axis of the body. The power tool is frequently equipped with an auxiliary handle in addition to the operating trigger grip handle. Most of these auxiliary handles are screwed into the tool body. The auxiliary handles can be removed but not moved to a different position on the power tool. Generally, the auxiliary handles are provided as cylinders, tapered cylinders, or bulbous knobs.

FIG. 1 illustrates an existing "angled grinder" power tool. The grinder has a motor housing 50, a rear cover 54, a gear housing 18, an auxiliary handle 61, a disc tool 38 and a wheel cover 34. Although the auxiliary handle 61 is shown on the left side of the tool, the position of the handle 61 can be switched to the right side of the tool by moving the handle 61 into a threaded hole 63 in the right side of the gear housing 18. When the grinder is used, the operator typically grasps the motor housing 50 and rear cover 54 with one hand and the auxiliary handle 61 with the other hand to control the position of the disc tool 38.

FIG. 2 illustrates an exploded view of an angled grinder power tool. The motor components 1-8, 37 and 39-55 are held within the motor housing 50 and the rear cover 54. The gear housing 18 holds the components 9-36 and 38 which include a first bevel gear 11 that is coupled to the end of the motor shaft/armature assembly 7. The first bevel gear 11 engages a second bevel gear 23 that is coupled to one end of the spindle 32. The opposite end of the spindle 32 is attached the disc tool 38. A wheel cover assembly 34 is attached to the bottom cover 28 of the gear housing 18.

A problem with auxiliary handles is that they are generally fixed in their relationship with the tool body. This can make the tool more difficult to use in tight spaces. Similarly, the tool head is generally fixed relative to the power tool, which limits the angle of the tool disk and may make the tool difficult to use. Another problem with prior art power tools is the tool head can be very thick. A lower profile extended tool head would allow the tool to be used in narrow spaces. What is needed is a power tool that has an adjustable auxiliary handle, adjustable tool head and an extended low profile tool head that addresses the problems with existing power tool grinders.

SUMMARY OF THE INVENTION

The inventive adjustable power tool includes a motor section, a tool head section, an adjustable handle, a disk tool and a tool guard. The motor section includes a motor and a motor housing. The motor is coupled to a drive shaft that extends from the motor housing through a center hole in the tool head. The tool head also has a gear system that is coupled to drive shaft. The disk tool has a center hole and is releaseably coupled to the drive system by securing the center hole of the disk tool to a threaded spindle and securing the tool between a flange and a lock nut. The lock nut is tightened to secure the disk tool.

The handle is coupled to the power tool at a locking mechanism that is coupled to a ring collar that surrounds a middle section of the power tool at the junction between the motor housing and the tool head. The handle and tool are adjustable in several ways. The tool head can be rotated relative to the motor housing around the coupling joint and around an axle in a clamping mechanism. The axle adjustment allows the handle to be moved forward towards the tool head or backwards towards the motor housing. The tool and handle are locked in placed by tightening the handle into the coupling joint. In an embodiment, the handle is tightened or loosened by rotating the handle axially. The handle tightening causes the coupling joint to tighten against the power tool to prevent rotation between the motor housing and the tool head. Tightening the handle also locks the coupling joint to prevent all axial and rotational movement of the handle relative to the power tool.

In an embodiment, the handle is coupled to a threaded rod that engages a threaded hole in a shoulder axle that is mounted between two strap retaining inserts that are attached to a strap. When tightened, the threaded handle rod pulls up on the threaded shoulder axle that in turn pulls the strap retaining inserts which tighten the strap. Simultaneously, a compression surface on the handle engages a cam that presses on a locking plunger into the side of the tool. This tightening of the locking mechanism prevents the strap and handle from rotating around the tool head and motor housing. Also, the tightening locks the cam against the locking plunger which then prevents axial rotation of the handle about the coupling joint. Thus, a user can lock the handle, the motor housing and tool head into the desired position.

In addition to the adjustable handle, the inventive power tool also has a movable tool guard. The guard is attached to the tool head and covers a portion of the disk tool and blocks pieces that may fly off of the disk tool during use. The guard may be semi-circular and have an edge that partially surrounds the outer diameter of the disk tool. The guard may also have a rotating mechanism that allows the guard to be rotated so that the guard is between the user and the work piece and the working section of the disk tool is clear. A locking mechanism allows the guard to be locked into a desired position. In an embodiment, the guard includes a leaf spring that has an end piece that engages notches in the tool head. The guard is locked in place when the tip of the spring is positioned within one of the notches of the gearbox flange. When a lock button is depressed, the leaf spring is deflected away from the notched ring and the wheel guard is free to rotate to a new position. Once properly positioned, the lock button is released to allow the spring tip to engage another notch in the flange.

DETAILED DESCRIPTION

The present invention is an improved adjustable hand held tool that has adjustable components. These adjustable components may be an adjustable auxiliary handle, an adjustable tool head, an improved low profile gearing system and an adjustable tool shield. The invention is directed towards a power tool that includes one or more of these improved features. In an embodiment, the present invention uses the motor and motor housing of the prior art grinder illustrated in FIG. 1. All other illustrated components of the grinder power tool are replaced with the inventive handle, tool head and guard.

Figure 3:
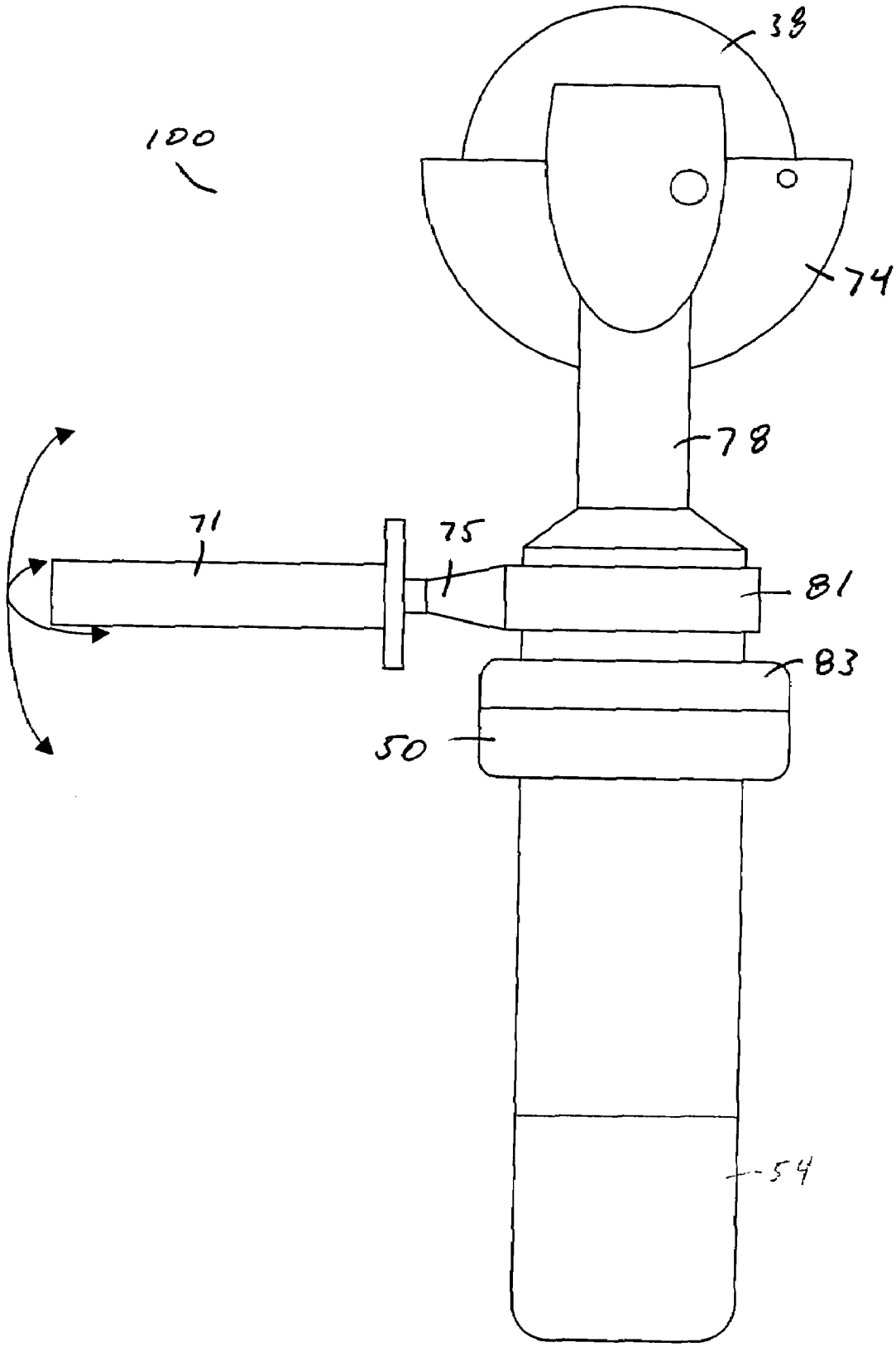
FIG. 3 is a top view of the power tool.

FIG. 3 illustrates a top view of an embodiment of the inventive adjustable power tool 100. The present invention includes a handle 71 that is attached by a locking mechanism coupling joint 75 that is attached to a collar 81. The collar 81 holds the tool head barrel extender 78 to the motor cover 83. The motor cover 83 is attached to the motor housing 50 and rear cover 54. The motor cover 83, motor housing 50 and rear cover 54 may be collectively referred to as the motor housing 50. In the preferred embodiment, the collar 81 is a cylindrical ring and the sections of the barrel extender 78 and motor housing 50 that are under the collar 81 are cylindrical. The inventive tool also includes a wheel guard 74 and a tool wheel 38. Note that the inventive grinder has a tool head barrel extender 78 is longer and has a much lower profile than the prior art gear housing 18 illustrated in FIG. 1. This allows the inventive power tool 100 to be used in smaller spaces than prior art grinders.

In an embodiment, the handle 71 is coupled to a threaded rod (not shown) that engages the locking mechanism coupling joint 75. With the handle 71 loosely engaging the coupling joint 75, the handle 71 and tool head 78 can be adjusted relative to the motor housing 50. The handle 71 can be moved forward and back about the locking mechanism coupling joint 75. The handle 71 and coupling joint 75 can also rotate with the collar 81 around the center axis of the power tool 100. The tool head 78 and motor housing 50 are also able to rotate relative to each other about the center axis of the tool 100.

When the handle 71 is screwed into the locking mechanism coupling joint 75, a plunder (not shown) is pressed against portions of the motor housing 50 and the tool head 78. The friction between the compression member, the motor housing 50 and the tool head 78 prevents any movement between the tool head 78, the motor housing 50 and the collar 81. In other embodiments, tightening the handle 71 causes the collar 81 to tighten around the motor housing 50 and the tool head 78 and also causes the motor housing 50 to be pressed against the tool head 78 and the friction between these components prevents relative movement and locks the components into their set positions.

Figure 4:
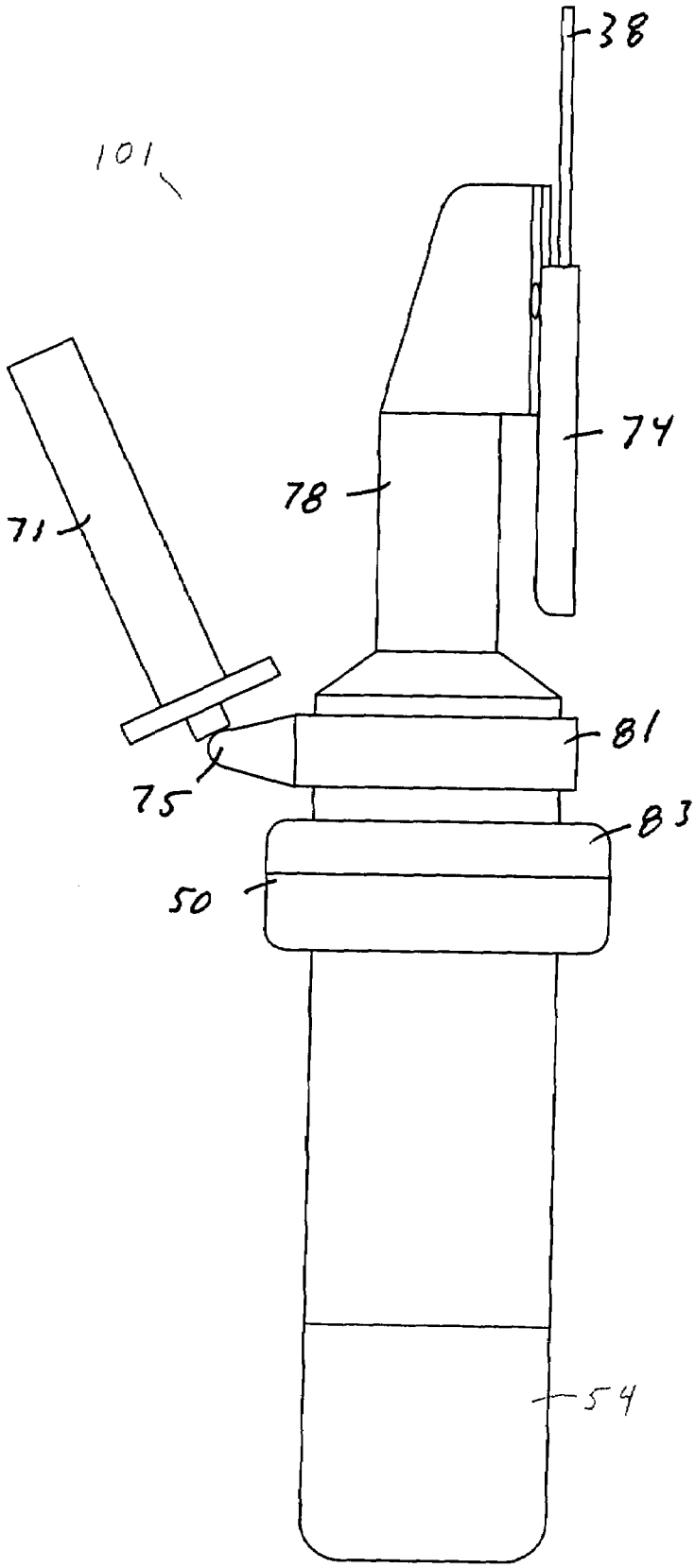
FIG. 4 is a side view of the power tool with the handle in a forward position.
Figure 5:
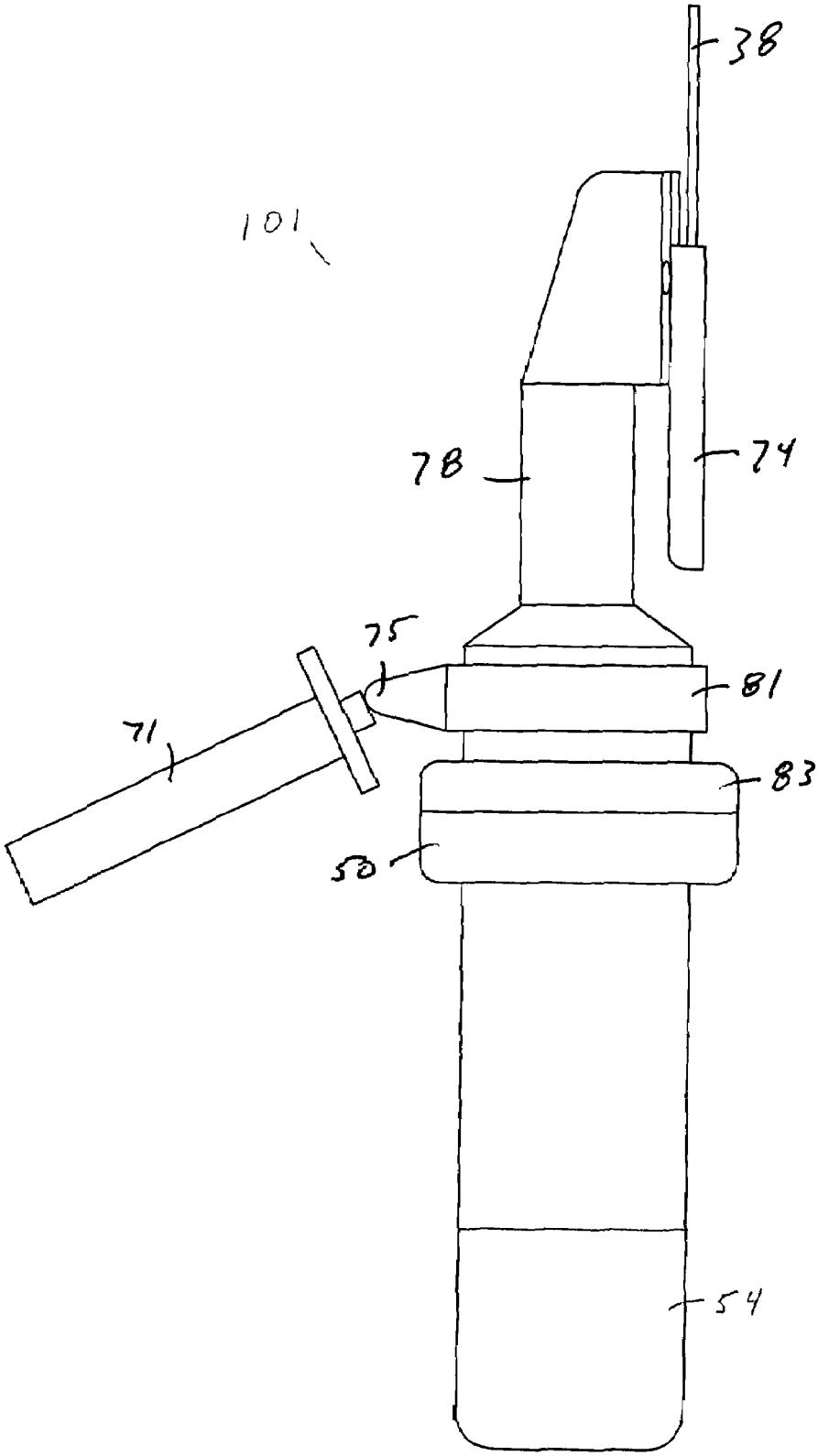
FIG. 5 is a side view of the power tool with the handle in a back position.

With reference to FIG. 4, another view of the inventive power tool 100 is shown with the tool head 78 and handle 71 moved into different positions. The handle 71 is positioned forward over the tool head 78 and the tool head 78 has been rotated to be perpendicular to the handle 71. FIG. 5 illustrates the handle 71 rotated towards the motor housing 50 and the tool head 78 perpendicular to the handle 71. The inventive power tool 101 allows the tool head 78 to rotate axially relative to the motor housing 50 and the handle 71 to rotate around the tool and as well as forward and backwards around the coupling joint 75.

Figure 6:
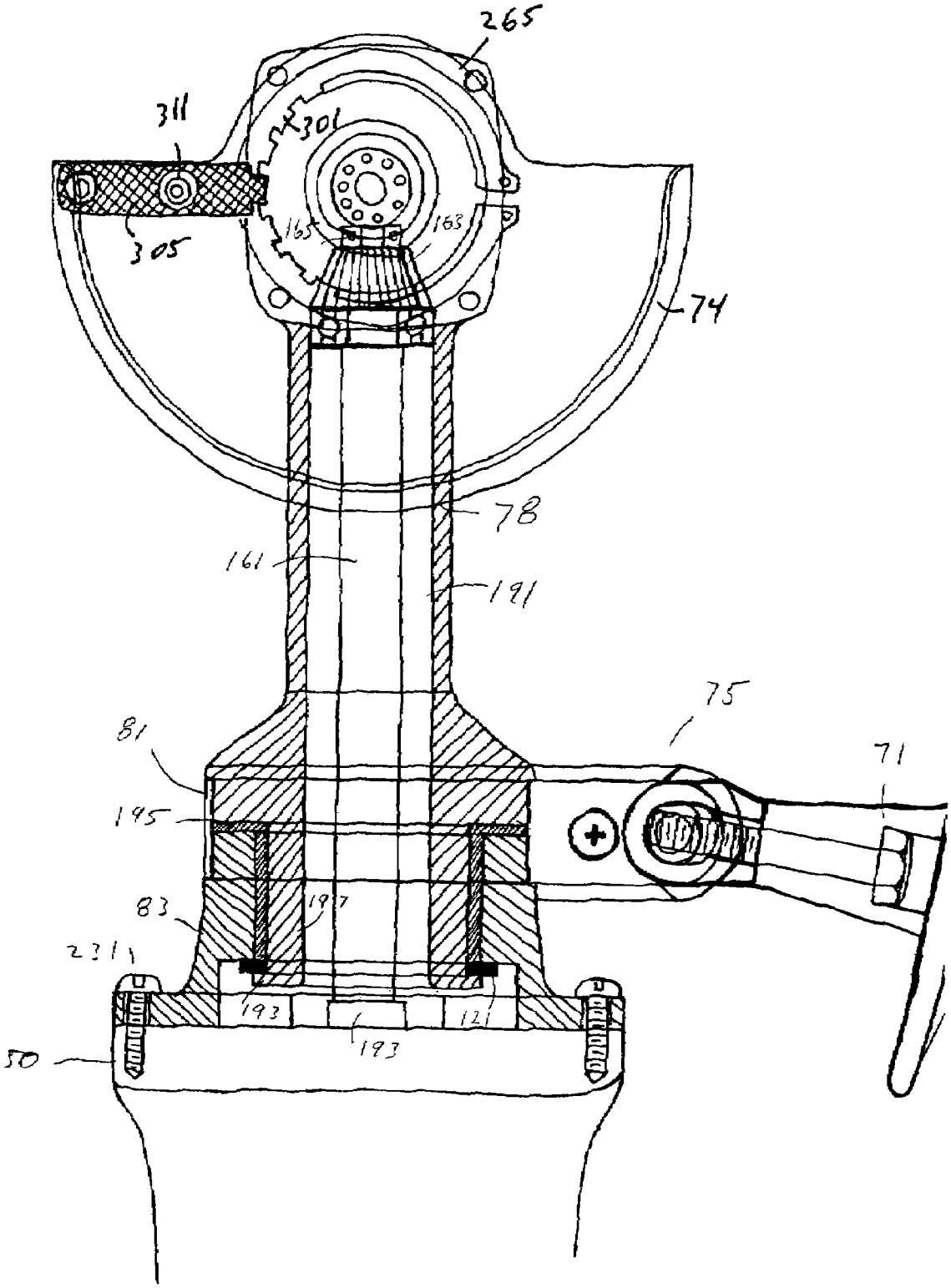
FIG. 6 illustrates a sectional top view of the power tool.

The internal components of an embodiment of the inventive adjustable tool are illustrated in FIGS. 6-10. FIG. 6 illustrates a cross section of the inventive tool. The motor cover 83 has a flange that is attached to the motor housing 50 with a plurality of fasteners 231 and a tubular section that extends away from the flange. A barrel extender 78 is a tubular structure that extends from the motor cover 83. A cylindrical bushing 195 is placed between the motor cover 83 and the barrel extender 78 at the junction of these components. The bushing 195 provides a smooth sliding surface and allows the tool head barrel extender 78 to rotate relative to the motor cover 83. The bushing 195 may be made of a plastic material such as nylon, Delrin, Teflon or other lubricated plastic material. During assembly, the bushing 195 is placed on the barrel extender 78 which is then inserted into the motor cover 83.

A lock ring 121 is attached to a lip portion 193 of the barrel extender 78 to secure the barrel extender 78 to the motor cover 83. The lock ring 121 is well known in the mechanical arts and is normally a flat circular piece of metal that is not closed. The inner and outer diameters of the lock ring 121 can expand or contract by flexing the circular material. The ends of the lock ring can have holes that can engage a special lock ring tool for installation or removal. After assembly, the lock ring 121 is placed over the lip 193 of the barrel extender 78. The bushing 195 has a smooth sliding surfaces that allows the tool head 78 to rotate axially relative to the motor cover 83.

A collar 81 surrounds the outer junction of the motor cover 83 and the barrel extender 78. In an embodiment, the collar 81 is a strap made of a strong flexible metal, a thicker machined metal or a composite fiber construction. In other embodiments, the collar 81 may be made of any other strong material. The collar 81 is coupled to a locking mechanism coupling joint 75 that is attached to the handle 71.

In an embodiment, axial rotation of the handle 71 relative to the locking mechanism coupling joint 75 loosens or tightens the collar 81 and the locking joint 75. Normally, clockwise rotation causes tightening and counter-clockwise rotation loosens, however the locking joint 75 can be configured to tighten or loosen in either rotation. When the handle 71 and locking mechanism 75 are loose, the handle 71, the collar 81, the motor housing 50 and barrel extender 78 are all free to rotate relative to each other. When the strap 83 is tightened by the locking assembly 173, the barrel extender 78 and handle 71 are locked in place relative to the motor housing 50. The locking mechanism coupling joint 75 will be described in more detail later in the application.

Figure 7:
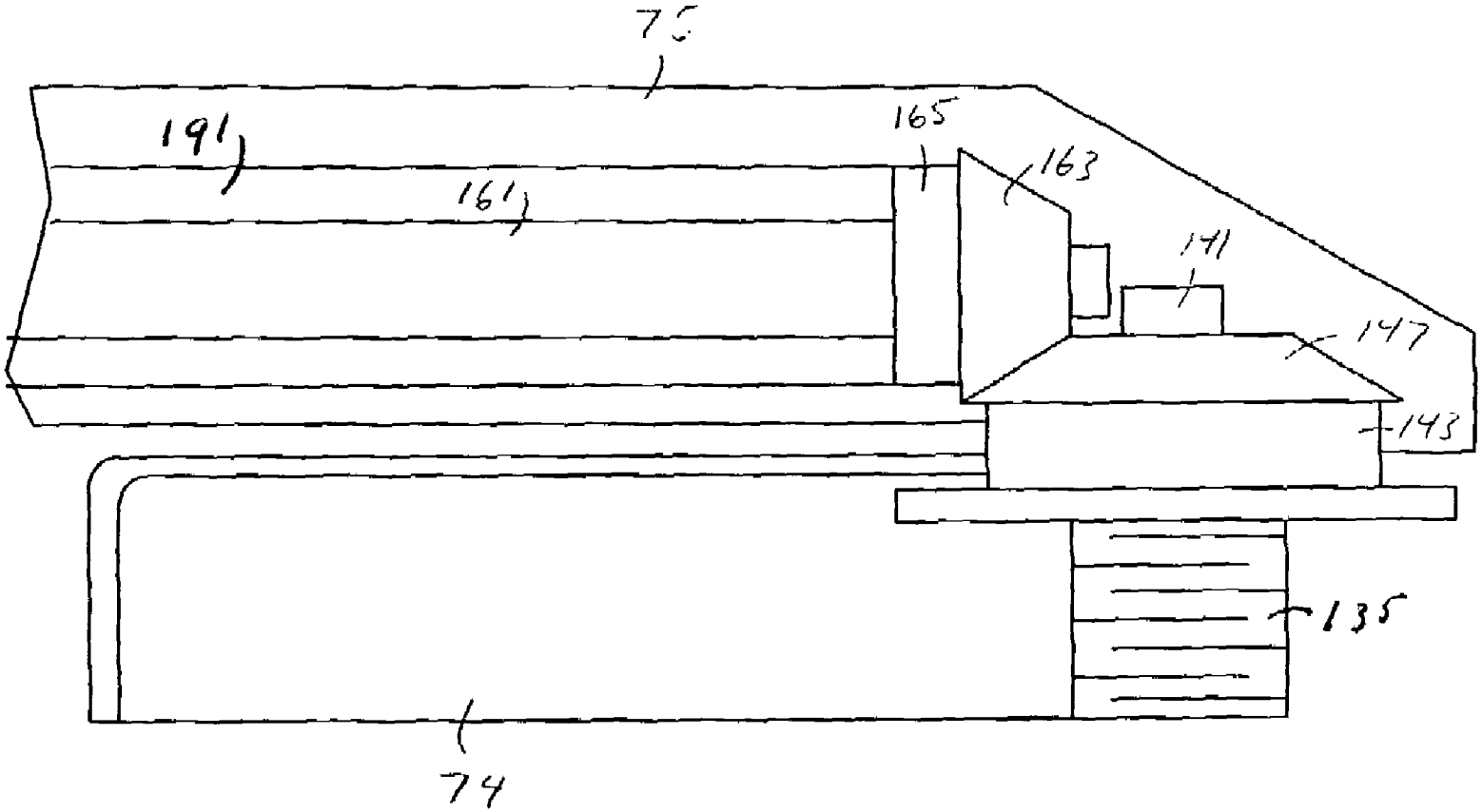
FIG. 7 illustrates a sectional side view of the tool head.

With reference to FIG. 7, the drive shaft 161 extends through the center of the motor cover 83 and the bore 191 within the barrel extender 78. The end of the drive shaft 161 is coupled to a bearing 165 mounted with the barrel extender 78 and a drive gear 163. The bearing 165 can be a sealed ball bearing, roller bearing, bushing or any other low friction rotation support mechanism. The drive gear 163 engages a bevel gear that is coupled to a spindle 135 that has a threaded end. The spindle 135 is supported by a first ball bearing 141 mounted above the bevel gear 147 and a second ball bearing 143 mounted below the bevel gear 147. When the drive shaft 161 rotates, the drive gear 163 causes the bevel gear 147 and the spindle 135 to rotate. A disk tool is mounted on the threaded end of the spindle 135 and a lock nut is used to secure the disk tool to the spindle 135.

Figure 8:
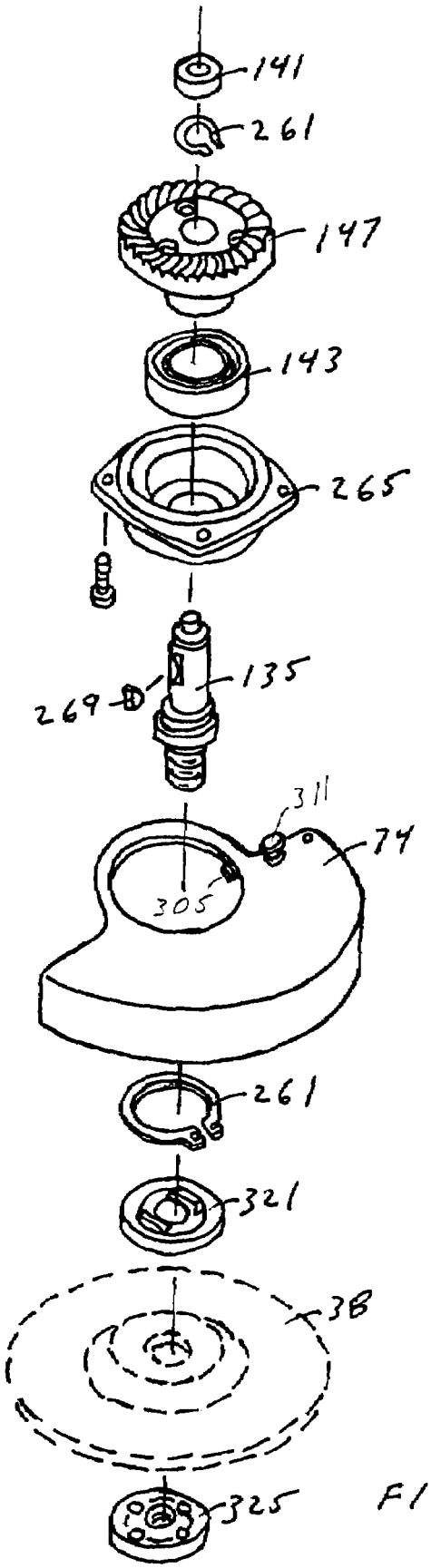
FIG. 8 illustrates an exploded view of the bevel gear components.

An exploded view of an embodiment of the spindle assembly 251 is shown in FIG. 8. The first ball bearing 141 is attached to the top of the spindle 135. A retaining ring 261 engages a slot in the spindle 135 and is mounted between the ball bearing 141 and the bevel gear 147. The second ball bearing 143 is mounted under the bevel gear 147 and these components are secured to the barrel extender 78 with a gearbox flange 265 and a plurality of fasteners. A woodruff key 269 is attached to the side of the spindle 135.

In an embodiment, the wheel guard 74 has a central circular hole that surrounds a tubular portion of the gearbox flange 265. A lock ring 261 engages a slot in the gearbox flange 265 and holds the wheel guard 74 against the gearbox flange 265. The lock ring 261 allows the wheel guard 74 to rotate about the gearbox flange 265.

The disk tool 38 is mounted on the bottom of the spindle 135 between a wheel flange 321 and a lock nut 325. The disk tool 38 is attached or removed from the spindle 135 when the bevel gear 147 is locked so that it cannot rotate. The tool head includes a lock button (not shown) that engages the bevel gear 147 and prevents the spindle 135 from rotating. To attach the disk tool 38, the user first actuates the lock button places the disk tool 38 and lock nut 325 on the threaded end of the spindle 135. The user then tightens the lock nut 325 with a wrench. When the lock nut 325 is tight, the user releases the lock button before using the power tool. To remove the disk tool 38 the user stops the tool and presses the lock button. The user then loosens and removes the lock nut 325 to remove the disk tool 38. In an embodiment, the lock nut 325 has a plurality of holes that are used to rotate the lock nut 325. In the case, a special wrench such as a spanner wrench, is used to tighten and loosen the lock nut 325 that has pins that engage holes.

With reference to FIG. 6, in an embodiment, the gearbox flange 265 includes a plurality of slots 301. An end of the leaf spring 305 is attached to the wheel guard 74. The attachment method may be a rivet, weld, fastener, solder, or any other fastening device. The tip 307 of the leaf spring 305 engages one of the plurality of slots 301 to prevent rotation of the wheel guard 74. A portion of the wheel guard lock button 311 passes through a hole in the wheel guard 74 and is exposed on the upper side of the wheel guard 74. When the lock button 311 is pressed, the leaf spring 305 is deflected and the tip 307 is removed from the slot 301. This allows the wheel guard 74 to be moved and locked in a new position. When the lock button 311 is released, the tip 307 of the leaf spring 305 returns to the slots 301 and the wheel guard 74 is locked into a new position.

Figure 9:
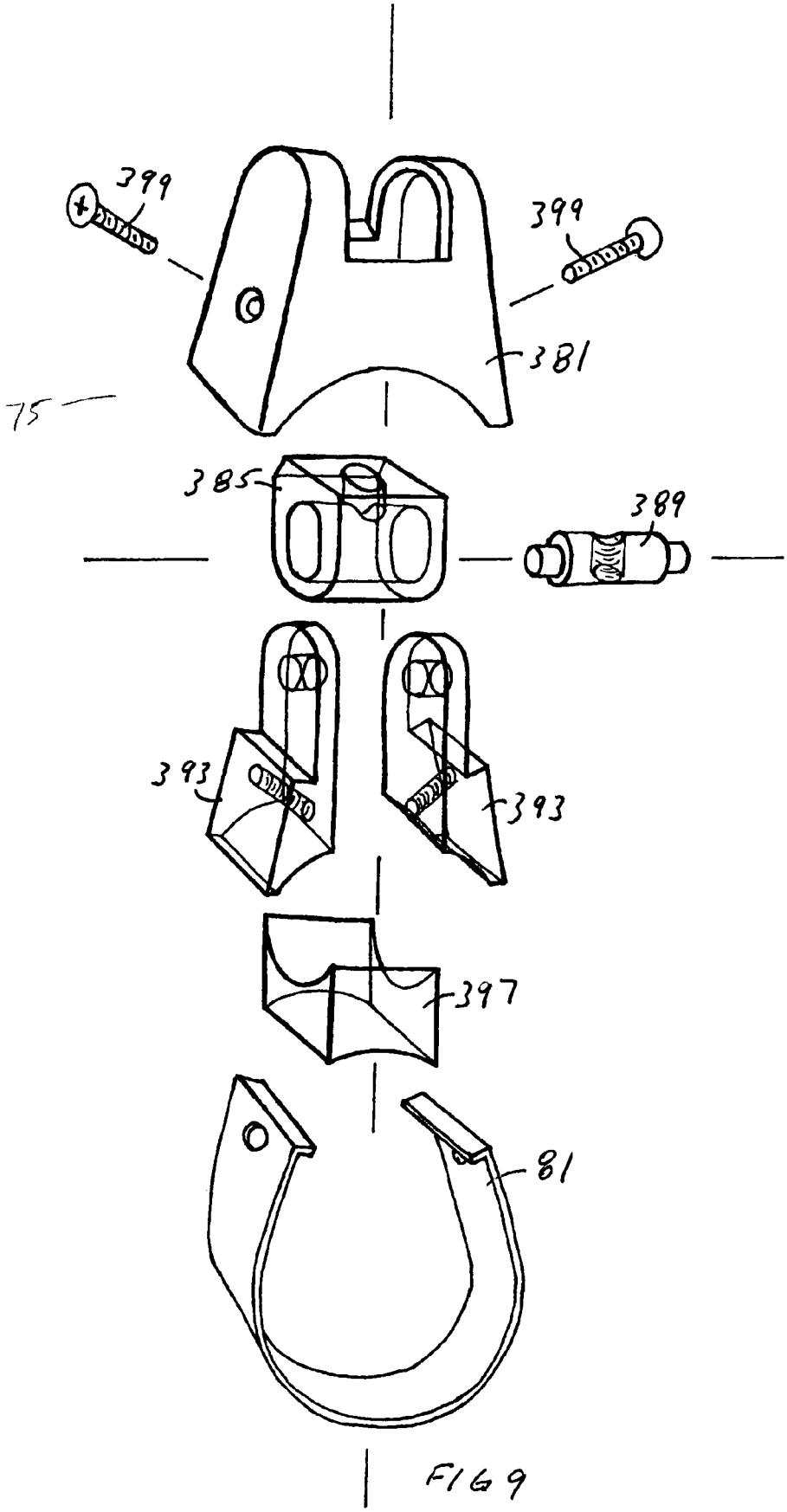
FIG. 9 illustrates an exploded view of the locking mechanism.

With referent to FIG. 9, an exploded view of an embodiment of the locking mechanism 75 and the collar 81 is illustrated. The locking mechanism 173 includes: a housing 381, a cam 385, a threaded axle 389, retaining inserts 393 and a locking plunger 397. The housing 381 is a hollow tapered structure that has lower edges that are concave and similar in shape to the circular section of the tool and a convex cylindrical upper surface with a hole. The other locking mechanism 173 components are at least partially mounted within the housing 381. The cam 385 has a vertical hole and an elongated horizontal hole that intersect within the cam 385. The upper surface of the cam 385 is a flat angled surface and the bottom is a convex cylindrical surface. The cam 385 is preferably made of a metal such as aluminum, steel, brass or any other strong metal.

The locking plunger 397 has a rectangular cross section and concave cylindrical upper and lower surfaces. The radius of the upper concave surface of the plunger 397 matches the radius of the convex cylindrical shape of the bottom of the cam 185. The radius of the lower concave surface of the plunger 397 matches the cylindrical surface at the junction of the motor housing 83 and the barrel extender 78. The locking plunger 397 is preferably made of a plastic material such as Delrin, Nylon, Teflon or similar plastic materials. However, in other embodiments, the plunger 397 can be made of any other solid strong material, such as metal, composite, ceramic or plastic.

The strap retainers 393 are fastened to the ends of the collar 81 and are mounted on opposite sides of the cam 385, axle 389 and locking plunger 397. There are numerous ways to secure the collar 81 to the strap retainers 393. In an embodiment, the ends of the collar 81 are bent inwards to form corners and holes are drilled in the ends. The retainers 393 have corresponding corners that engage the bent portions of the collar 81. The housing 381 and the retainers 393 have holes threaded holes that allow the collar 81 to be secured between the housing 381 and the retainers 393 with fasteners 399. The fasteners 399 are placed through the holes in the housing 381, the collar 81. The fasteners 399 are tightened into the threaded holes in the retainers 393. This prevents movement between the collar 81, retainers 393 and housing 381. The fasteners 399 may be screws, bolts, rivets or other type of fastening mechanism.

The inner surfaces of the retainers 393 are smooth planar surfaces that allow the cam 385 and locking plunger 397 to slide vertically against the retainers 393. The axle 389 is placed through the horizontal slot in the cam 385 and the ends of the axle 389 engage holes in the retainers 393. The axle 389 is free to rotate within the retainers 393. The axle 389 has a threaded hole that runs across the center width of the axle 389. The threaded hole is positioned in line with the vertical hole in the cam 385. This orientation allows a threaded rod of the handle 71 to pass through the vertical hole in the cam 385 and be secured to the threaded hole in the axle 389.

The handle 71 includes a compression surface that engages a portion of the locking joint mechanism 75. When the handle 71 is tightened against the locking mechanism 75, the compression surface of the handle 71 pushes down on the top of the cam 385 and plunger 397 while the threaded rod pulls up on the axle 389. The movement of the axle 389 pulls the retainers 393 up which tightens the collar 81 around the power tool. Simultaneously, the downward force on the cam 385 against the locking plunger 397. Because the junction of the cam 385 and the plunger 397 are matching cylindrical surfaces, there can be some rotational movement between these pieces as well as angular movement of the applied compression force. The compression force is aligned with the threaded rod. Regardless of the compression force angle, there is still a large contact area between the cam 385 and the plunger 397. When the handle 71 is tightened, this compression causes friction between the cam 385 and the plunger 397 preventing relative movement between these pieces. This locks the handle 71 and prevents rotation relative to the locking joint mechanism 75.

The tightening of the handle 71 and downward force on the cam 385 also pushes the locking plunger 397 against the motor housing 83 and the barrel extender 78. Because the plunger 397 is made of a relatively soft material, the compressed bottom surface area conforms to the contact shape of the motor housing 83 and the barrel extender 78. The plunger 397 is compressed with sufficient force and friction to lock the motor housing 83 and the barrel extender 78 in place and prevent relative movement.

Figure 10:
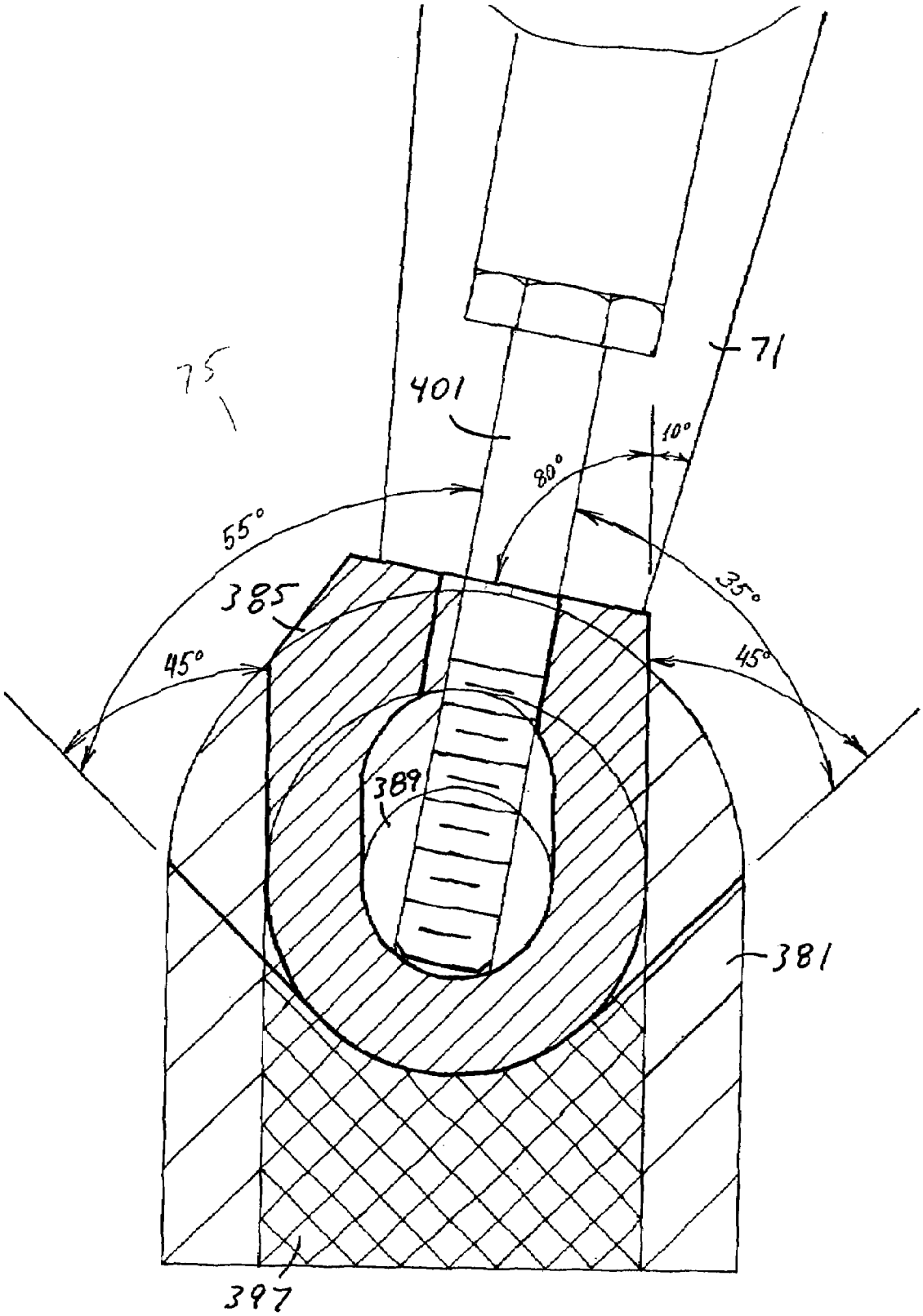
FIG. 10 illustrates a cross sectional view of the locking mechanism.

As discussed, the handle 71 can rotate about the locking mechanism 173. In an embodiment, this rotation is limited by the locking joint mechanism 75. With reference to FIG. 10, a cross section view of the locking mechanism 173 is shown. The handle 71 includes a threaded rod 401 that passes through the vertical hole in the cam 385 and is secured to the threaded hole in the axle 389. In this embodiment, when the cam 385 is vertically oriented (as shown) the upper surface of the cam and the handle 71 are angled at 10 degrees towards the disk tool. The bottom of the cam 385 has a convex cylindrical surface and the upper surface of the plunger 397 has a corresponding concave cylindrical surface. The upper surface of the plunger 397 and the housing 381 allow the cam 385 to be rotated across a range of angles. In this embodiment, the range of angles is about 90 degrees. The angled edges of the housing 381 and the upper surface of the plunger 397 prevent additional movement beyond the 90 degrees of travel. Because the top of the cam 385 is angled at 10 degrees towards the disk tool, the handle 71 can move 55 degrees forward of vertical center and 35 degrees back from vertical. In other embodiments, the range of movement can be altered to provide a wider or narrower range of travel. In this embodiment, the range of travel is intended to prevent the handle 71 and user's hands from contacting the disk tool or the motor housing.

Figure 1:
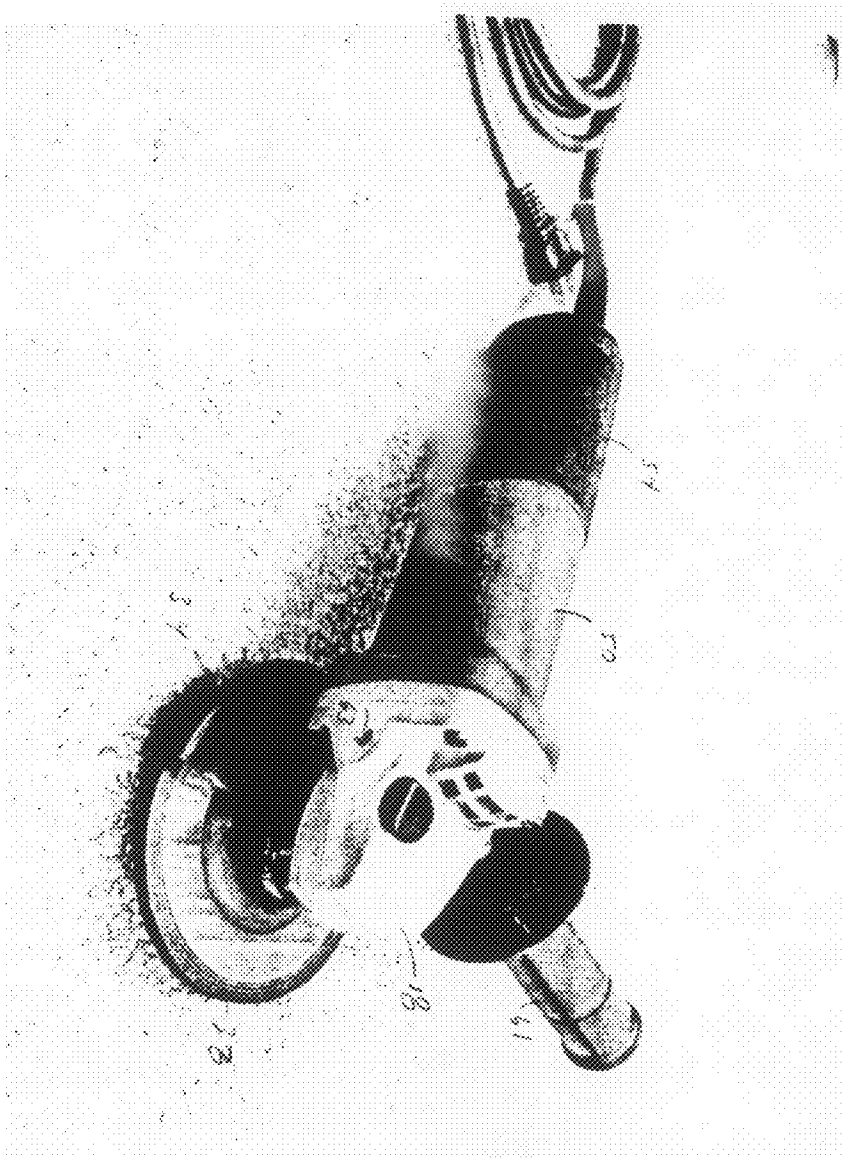
FIG. 1 (PRIOR ART)
FIG. 1 is an elevation view of a prior art grinder power tool.
Figure 2:
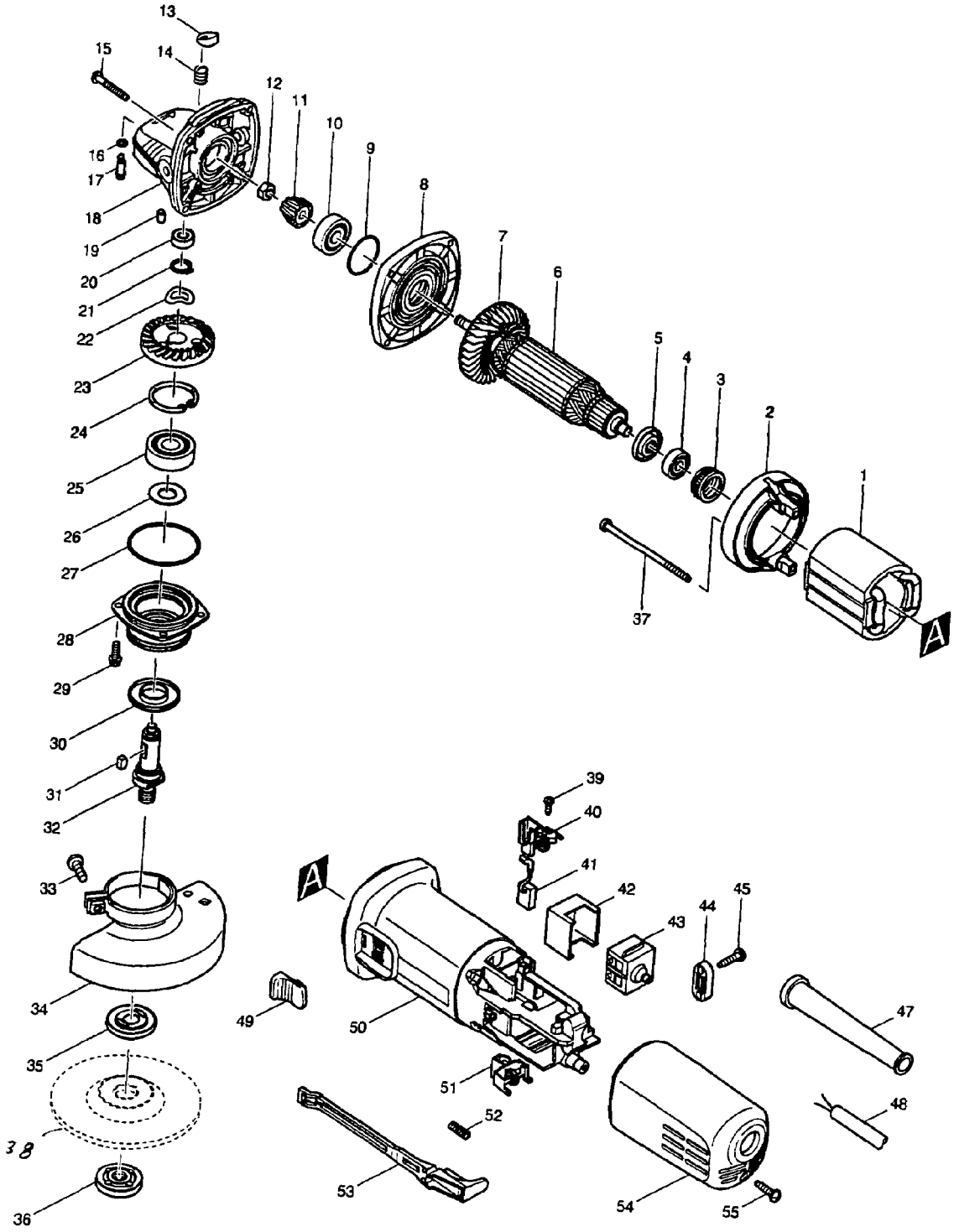
FIG. 2 (PRIOR ART)
FIG. 2 is an exploded view of the prior art grinder power tool.

In a normal power tool gearing system shown in FIG. 2, the bevel gear 23 is mounted in a gear housing 18 and required a great number of additional components such as: bearings 20, retaining rings 21, washers 22, spindle 32, etc. Because there are many components the mechanism is more complex than necessary and requires a wide gear housing 18. This large gear housing 18 is problematic when the tool must be used in tight spaces. By improving the design of the gear housing by using fewer parts, the inventive power tool head is substantially thinner and can be used in more confined spaces. The narrower design is possible because the second bevel gear 147 used in the inventive hand held tool is substantially different than the prior art power tool gear mechanisms as illustrated in FIGS. 1 and 2.

Figure 11:
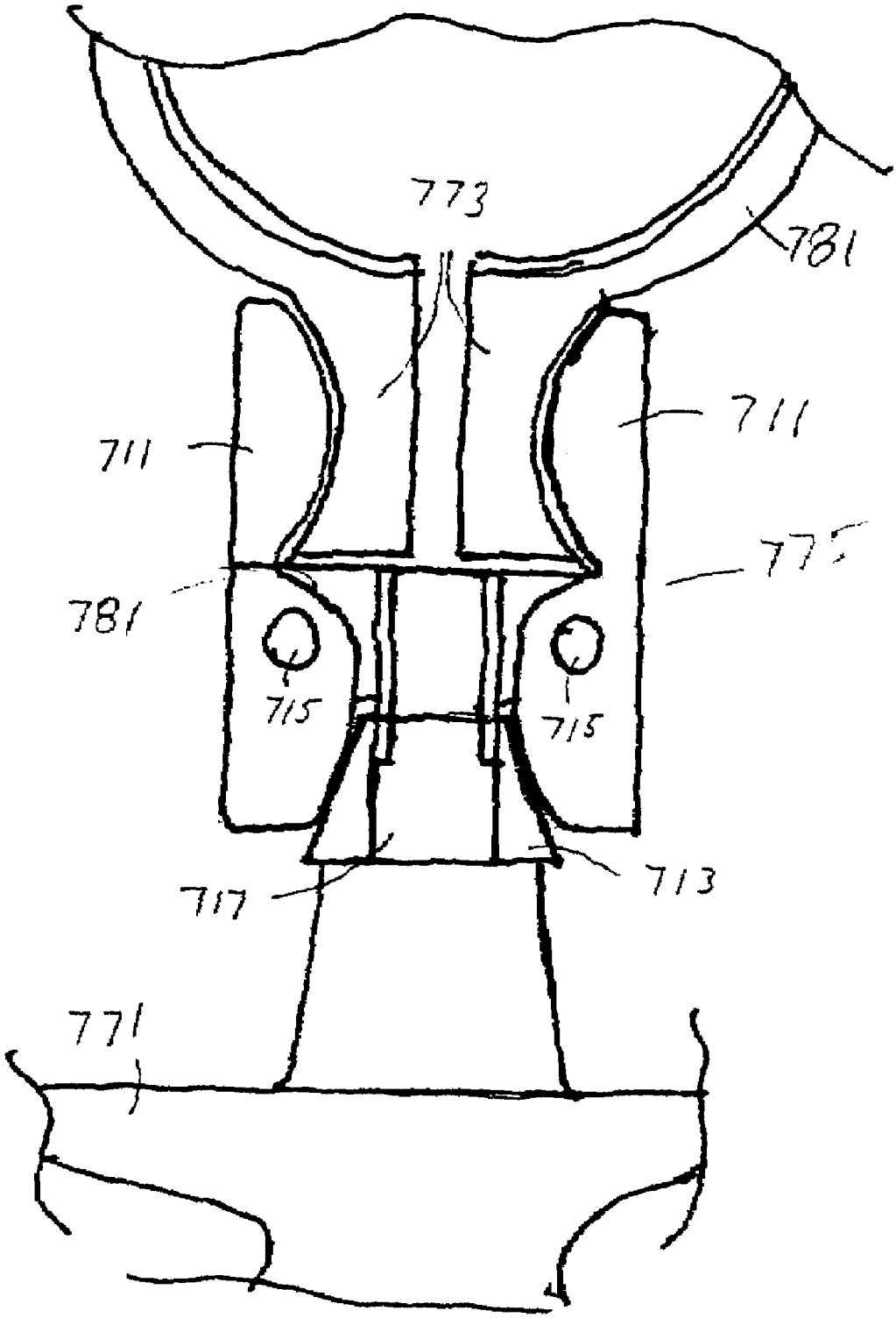
FIG. 11 illustrates a sectional view of an alternative embodiment of the locking mechanism.

Although the present invention has been described in a specific embodiment, other mechanisms are contemplated that perform the same functionality. With reference to FIG. 11, an alternative embodiment of the locking mechanism 701 is illustrated as a cut away view of the locking joint mechanism 775. The two flanges 773 of the collar 781 are coupled to the handle 771 through a locking joint mechanism 775 that includes several mechanical components. The locking joint mechanism 775 allows the handle 771 and tool head 778 to be adjustable and also locks these components in a position desired by the user. The flanges 773 have concave spherical surfaces that engage two convex spherical surfaces on two members 711. The spherical surfaces provide a large contact surface area and allow the convex spherical surface of the members 711 to rotate against the concave spherical surfaces of the flanges 773.

The members 711 rotate about pivot rods 715 that are coupled to the body 781 of the joint mechanism 775. The body 781 has an upper surface (not shown) and a lower surface that engages the ends of the pivot rods 715 and hold the members 711 on the pivot rods 715. When the members 711 rotate towards the flanges 773, the collar 781 diameter decreases locking the motor cover 750, the tool head and handle 771 in position.

The body 781 also has a threaded center bore. The members 711 are rotated by the movement of a wedge 713 that is placed on a shaft 717 at the end of the handle 771. The wedge 713 has a center hole and two tapered and planar wedge surfaces. The shaft 717 is threaded into the center bore in the body 781. When the handle 771 is rotated about its center axis, the threads of the shaft 717 engage the threads in the body 781 and the shaft 717 move the wedge 713. If the handle 771 is rotated clockwise, the shaft 717 is pulled into the body 781 and the wedge is forced between the members 711. The rotation of the members 711 causes the spherical surfaces to clamp onto the flanges 773 locking joint mechanism 775. Conversely, if the handle is rotated 771 counter-clockwise, the shaft 717 moves away from the body 781 and the wedge moves away from the members 711 loosening the collar 781. In an embodiment, the joint mechanism 775 has a locking mechanism that prevents the rotation of the handle 771 and shaft 717 from the body 781. This locking mechanism may prevent the accidental unlocking of the handle 771.

It is contemplated that various other locking joint mechanisms can be used with the present invention. For example, the handle 771 may have a tapered inner diameter that engages an outer surface of the members 711. By screwing the handle 771 into the housing, the inner diameter causes the members 711 to tighten around the flanges 773 causing the collar 781 to tighten which locks the handle 771 in place. Additional details of the alternative embodiment are disclosed in U.S. Provisional Application No. 60/781,045.

In the preferred embodiment, the components of the inventive adjustable handheld tool are made of metals or metal alloys that are easily machinable. Typical metals used include: aluminum/aluminum alloys, steel alloys such as tool steel 4042, Stainless steels, brass and any other type of suitable metal. The components may be formed from castings, billets, bar/rod stock, etc. The components may be machined with lathes, drills, and CNC machines. Some of the components may be commonly available items such as bearings, nuts, lock rings, o-rings and gears.

While the present invention has been described in terms of a preferred embodiment above, those skilled in the art will readily appreciate that numerous modifications, substitutions and additions may be made to the disclosed embodiment without departing from the spirit and scope of the present invention. For example, it is also possible to use the present invention in various other types of hand tools such as: planers, drills, routers, saws, etc. The inventive adjustable handle system can also be used with other hand-operated devices such as handlebars, lawn mowers, edges, chainsaws, or any other mechanisms that use handgrips. It is intended that all such modifications, substitutions and additions fall within the scope of the present invention that is best defined by the claims below.

What is claimed is:

1. An adjustable power tool comprising:

a handle coupled to a threaded rod;

a power tool housing;

a locking mechanism coupling the handle to the housing, the locking mechanism comprising:

a cam having a curved surface, a first hole and a second hole wherein the first hole and second hole intersect;

an axle having a threaded hole wherein the axle is mounted within the second hole of the cam;

a plunger that is mounted between the power tool housing and the curved surface of the cam; and a collar that is coupled to the axle and surrounds a portion of the power tool housing;

wherein the threaded rod is coupled to the threaded hole in the axle and when the threaded rod is rotated in a first direction within the threaded hole, the collar and handle can rotate around a center axis of the power tool and when the threaded rod is rotated in a second direction within the threaded hole, the collar tightens around the power tool housing and the cam presses the plunger against the power tool housing locking the handle against rotation.

2. The power tool of claim 1 wherein the curved surface of the cam has a cylindrical shape and the upper surface of the plunger has a corresponding cylindrical surface that engages the curved surface of the cam, wherein when the threaded rod is rotated in the second direction within the threaded hole, the plunger is compressed against the power tool housing.

3. The power tool of claim 1 further comprising:

a motor cover portion of the power tool housing; and a barrel extender portion of the power tool housing;

wherein the collar is coupled to the motor cover and the barrel extender.

4. The power tool of claim 3 wherein when the threaded rod is rotated in a first direction within the threaded hole, the barrel extender can rotate relative to the motor cover.

5. The power tool of claim 1 wherein the axle and the cam can rotate relative to the plunger.

6. The power tool of claim 5 wherein the plunger limits the rotation of the cam.

7. The power tool of claim 1 wherein the axle moves relative to the cam when the threaded rod is rotated in the first direction or rotated in the second direction within the threaded hole.

8. The power tool of claim 1 wherein friction between the cam and the plunger prevent axial movement of the threaded rod and the handle when the threaded rod is rotated in the second direction within the threaded hole.

9. The power tool of claim 3 further comprising:

a slotted ring coupled to the barrel extender;

a wheel guard that is coupled to the barrel extender; and a leaf spring coupled to the wheel guard;

wherein the wheel guard is rotatable around a portion of the barrel extender and the leaf spring engages a portion of the slotted ring to prevent the rotation of the guard wheel.

10. The power tool of claim 9 further comprising:

a locking button that is coupled to the leaf spring;

wherein when the locking button is actuated, the loaf spring disengages from the slotted ring so the wheel guard can rotate around the portion of the barrel extender.

11. An adjustable power tool comprising:

a power tool housing;

a collar that is attached to the power tool housing;

a locking mechanism that is coupled to the collar; and a handle that includes a threaded rod that is coupled to the locking mechanism;

wherein when the threaded rod is rotated in a first direction relative to the locking mechanism, the collar is movable around the power tool housing and the handle is movable relative to the power tool and wherein when the threaded rod is rotated in a second direction relative to the locking mechanism, the locking mechanism tightens the collar around the power tool housing preventing the collar from moving around the power tool housing and locking the handle in place preventing the handle from moving relative to the power tool housing.

12. The power tool of claim 11, wherein the locking mechanism includes a cam and a plunger that are mounted between the handle and the power tool housing and when the threaded rod is rotated in a second direction relative to the locking mechanism the cam compresses the plunger against the power tool housing.

13. The power tool of claim 12 wherein the cam has a cylindrical surface and the plunger has a corresponding adjacent cylindrical surface that allows the cam to rotate relative to the plunger.

14. The power tool of claim 11 wherein a portion of the handle contacts the locking mechanism when the threaded rod is rotated in a second direction relative to the locking mechanism.

15. The power tool of claim 11 wherein the locking mechanism includes a compression device that tightens the collar around the power tool housing when the threaded rod is rotated in a second direction relative to the locking mechanism.

16. The power tool of claim 15 wherein the collar has a split section and a flange attached to each end of the clamp and the compression mechanism presses the two flanges towards each other when the threaded rod is rotated in a second direction relative to the locking mechanism.

17. The adjustable power tool of claim 11 further comprising:

an elongated barrel extender having a center hole;

a drive shaft that is mounted in the center hole and coupled to a drive gear;

a spindle coupled to a bevel gear that engages the drive gear; and a disk tool coupled to one end of the spindle.

18. The power tool of claim 11 further comprising:

a slotted ring coupled to the tool housing;

a wheel guard that is coupled to the barrel extender; and a leaf spring coupled to the wheel guard:

wherein the wheel guard is rotatable around a portion of the barrel extender and the leaf spring engages a portion of the slotted ring to prevent the rotation of the guard wheel.

19. The power tool of claim 18 further comprising:

a locking button that is coupled to the leaf spring;

wherein when the locking button is actuated, the loaf spring disengages from the slotted ring so the wheel guard can rotate around the portion of the barrel extender.

20. The power tool of claim 11 wherein the threaded rod is mounted along a center axis of the handle.

* * * * *